US007316459B2

(12) United States Patent
TenBrink

(10) Patent No.: US 7,316,459 B2
(45) Date of Patent: Jan. 8, 2008

(54) MODULAR EXPANDABLE DISPLAY CASE

(76) Inventor: Carl Evan TenBrink, 17862 Metzler La., Huntington Beach, CA (US) 92647

( * ) Notice: Subject to any disclaimer, the term of this patent is extended or adjusted under 35 U.S.C. 154(b) by 646 days.

(21) Appl. No.: 10/855,460

(22) Filed: May 27, 2004

(65) Prior Publication Data

US 2005/0263473 A1 Dec. 1, 2005

(51) Int. Cl.
*A47F 3/00* (2006.01)

(52) U.S. Cl. ..... 312/114; 312/205

(58) Field of Classification Search ..... 211/189, 211/204, 206; 220/4.26, 4.28; 312/107, 312/108, 111, 257.1, 263, 265.5, 265.6, 205, 312/114, 140, 140.1–140.4
See application file for complete search history.

(56) References Cited

U.S. PATENT DOCUMENTS 1,423,714 A * 7/1922 Fry ..... 312/31.04
1,594,385 A * 8/1926 Strauss ..... 312/114
1,627,084 A * 5/1927 Fritz ..... 312/107
2,300,776 A * 11/1942 Collins ..... 47/69
3,012,835 A * 12/1961 Anderson et al. ..... 312/265.5
3,288,301 A * 11/1966 Kent et al. ..... 211/41.17
3,401,993 A * 9/1968 Fenkel ..... 312/111
4,293,072 A * 10/1981 Hill et al. ..... 206/512
4,694,965 A * 9/1987 Parnell ..... 211/87.01
5,435,644 A * 7/1995 Schuh et al. ..... 312/257.1
5,642,923 A * 7/1997 Meacham et al. ..... 312/258
5,924,778 A 7/1999 TenBrink
6,027,192 A * 2/2000 Irace ..... 312/263

* cited by examiner

*Primary Examiner*—Janet M. Wilkens
(74) *Attorney, Agent, or Firm*—Walter A. Hackler

(57) ABSTRACT

A display case includes at least one L shaped bottom member having a bottom and an upstanding back along with an L shaped top member having a top and a depending back. A tongue is disposed on an edge of one of the backs and a groove is disposed on an edge of another of the backs for coupling the backs to one another. Back extensions are provided in order to extend a distance between the top and bottom upon assembly of the bottom member, top member and the back extension. End caps and end cap extensions are configured for engaging the bottom and top for closing ends of the bottom member and the top member.

7 Claims, 3 Drawing Sheets

MODULAR EXPANDABLE DISPLAY CASE

The present invention is generally related to display systems and is more particularly directed to a modular display case.

Display cases are often used for presenting merchandise for retail purposes as well as for collectors for visibly showing their treasures.

It is often desirable to provide a modular display case which is expandable horizontally and vertically in order to accommodate expanding numbers of items in a collection.

One such modular display case is illustrated in U.S. Pat. No. 5,924,778 to TenBrink which is particularly suitable for displaying model trains and expandable, both horizontally and vertically to accommodate various trains and various types of other collectibles.

While the modular configuration of the display case taught in U.S. Pat. No. 5,924,778 enables the horizontal and vertical expansion of the assembled case, the case is limited in not providing variable shelf height which can accommodate collectibles of differing stature.

Accordingly, there is a need for a display system that permits the viewing of collectibles of varying heights, that is a system specifically adjustable for such height variation while at the same time maintaining the modular, vertical and horizontal expandability. The present invention fills that need.

SUMMARY OF THE INVENTION

A display case in accordance with the present invention includes at least one L shaped bottom member having a bottom and an upstanding back and at least one L shaped top member includes a top and a depending back.

A tongue, disposed on an edge of one of the backs, and a groove, disposed on an edge of another of the backs, is provided for coupling the backs to one another. This structure enables the individual shelves of an assembled display case to have customized height, as hereinafter described in greater detail.

A longitudinal recess is formed into each of the backs is provided for enabling wall mounting screw heads to be countersunk in the backs. This structure enables the installation of back panels or the like in the display case. End caps are provided and configured for engaging the back and top for closing ends of the bottom member and the top member.

More particularly, in order to utilize structure for adjusting the height of individual shelves, a back extension may be provided having an extension tongue, disposed on one end thereof for engaging the back tongue, and an extension groove disposed on another end thereof, for engaging the back groove in order to extend a distance, or height, between the top and bottom upon assembly of the bottom member, top member, and back extension.

Also provided is a longitudinal recess formed into the back extension for enabling the wall mounting screw heads to be countersunk into the back extension. This countersinking capability enables a backdrop, or panel as hereinabove noted, to be easily inserted into the display case without interference of the mounting screw heads.

In addition, end cap extensions are provided with each having a length equal to the back extension and each configured for engaging a respective end cap, back, top and back extension for closing ends of the bottom and top members.

In order to provide vertical modularity, flanges formed in one of the tops and bottoms and slots formed in another of the tops and bottoms enable stacked coupling of a plurality of display cases, as hereinafter described in greater detail.

To provide horizontal modularity, channels are disposed in the top and bottom and rods are provided for enabling side-by-side coupling of display cases.

Accordingly, the display case in accordance with the present invention may include a plurality of L shaped bottom members, a plurality of L shaped top members which may be coupled, as hereinabove and hereinafter described.

BRIEF DESCRIPTION OF THE DRAWINGS

The advantages and features of the present invention will be better understood by the following description when considered in conjunction with the accompanying drawings in which.

DETAILED DESCRIPTION

Figure 1:
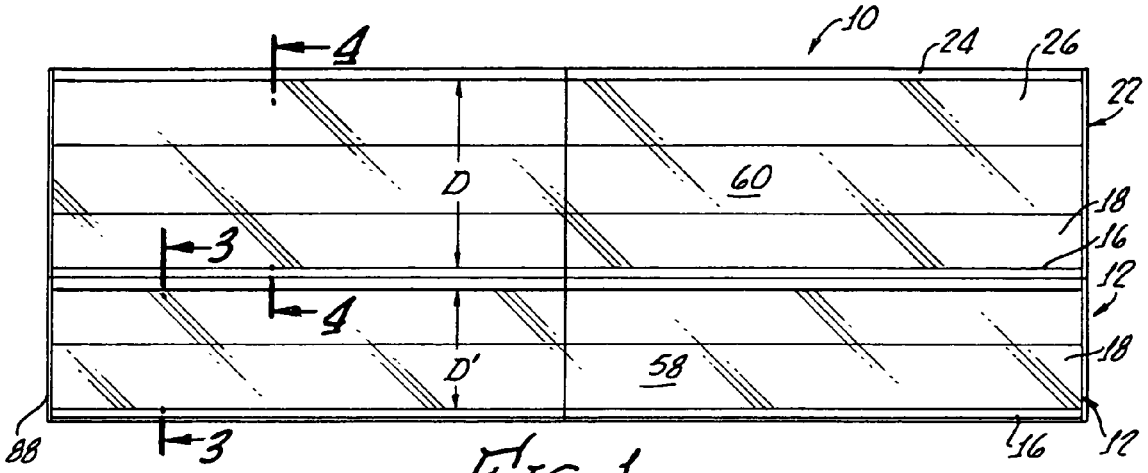
FIG. 1 is a front plan view of a display case in accordance with the present invention generally showing shelves of various heights enabled by the modularity of the present invention and generally showing L shaped bottom members, L shaped top members, extensions and end caps.
Figure 2:
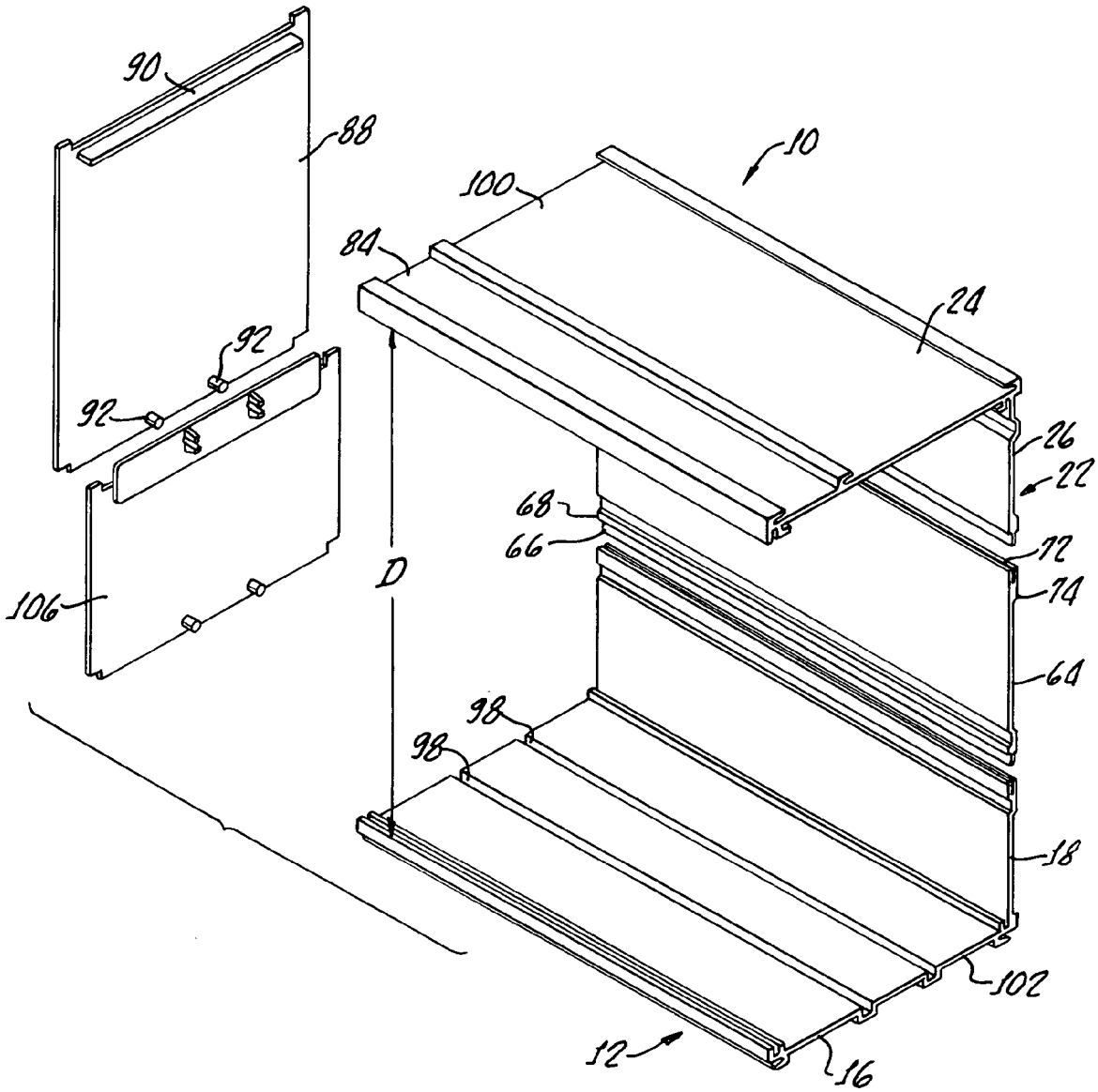
FIG. 2 is an exploded perspective view of the display case shown in FIG. 1 more particularly showing the elements identified in FIG. 1.

With reference to FIGS. 1 and 2, there is shown a display case 10 in accordance with the present invention illustrating L shaped bottom members 12 having bottoms 16 and backs 18 and L shaped top members 22 including tops 24 and backs 26.

The L shaped bottom member 12 and L shaped top member 22, as well as all other components of the present invention may be formed from any suitable material such as plastic or metal and manufactured in a conventional manner.

Figure 3:
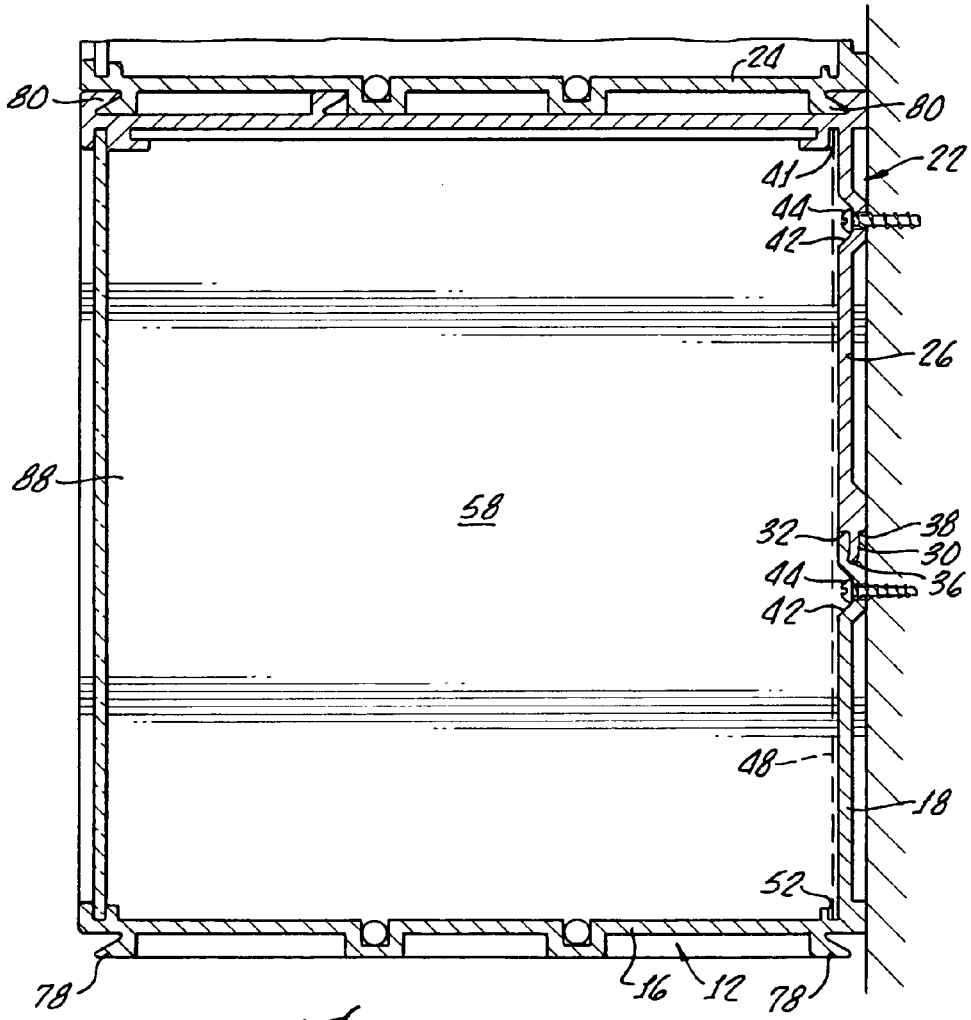
FIG. 3 is a cross sectional view taken along the line 3-3 of FIG. 1.

As most clearly shown in FIG. 3, a tongue 30 disposed on an edge 32 of the top member and depending back 26 provides engagement with a groove 36 disposed in an edge of the bottom member upstanding back 18 for not only enabling engagement of the bottom member 12 with the top member 22, but for enabling an extension of a distance between the bottom 16 and the top 24, as hereinafter discussed in greater detail.

It should be appreciated that while the tongue 30 is illustrated as being formed in an edge 32 of the top member back 26 and the groove 36, is illustrated in an edge 38 of the bottom member back 18, a reverse configuration can be utilized.

Longitudinal recesses 42 are provided for enabling wall mounting screw heads 44 to be countersunk in the backs 18, 26. This facilitates placement of a backdrop 48, such as a pictorial representation, or scene, in grooves 52, 54 in order to provide a scenic background for items, not shown, disposed in a display case cavity 58.

In order to provide a cavity 60 of greater height, as shown in FIG. 1, a back extension 64, see FIG. 2, is utilized in accordance with the present invention.

The back extension 64 includes an extension tongue 66 on one end 68 thereof and an extension groove 72 disposed on another end 74 thereof.

The extension tongue 66 is sized and configured for engaging the groove 36 of the bottom back 80 and the groove 72 is sized and configured for accepting the tongue 30 extending from the top back 26, as illustrated in FIG. 2. Accordingly, a distance D between the bottom 16 and top 24 can be adjusted through the use of the back extension 64, to provide different heights as illustrated in FIG. 1 as D and $D^1$.

Thus, the display case 10 in accordance with the present invention may be modulated to accommodate collection items of various heights. This feature as heretofore been not available.

Stacking of the bottom members 12 and top members 22 is facilitated by flanges 78 and slots 80. This arrangement is shown in U.S. Pat. No. 5,924,778 to TenBrink and this patent is to be incorporated herewith in its entirety by this specific reference thereto for illustrating the vertical and modular expandability of the present invention.

Channels 84 enable horizontal expansion of the display case 10 also as set forth in U.S. Pat. No. 5,924,778 incorporated herewith. Accordingly, further details with regard to the vertical and horizontal expansion of the display case 10 are not provided herewith for the sake of clarity.

Referring to FIGS. 1-4, end caps 88 are provided and configured through the use of flanges 90 and rods 92 for engaging slots 96 and grooves 98 respectively for enclosing ends 100, 102 of the bottom and top members 12, 22.

Figure 4:
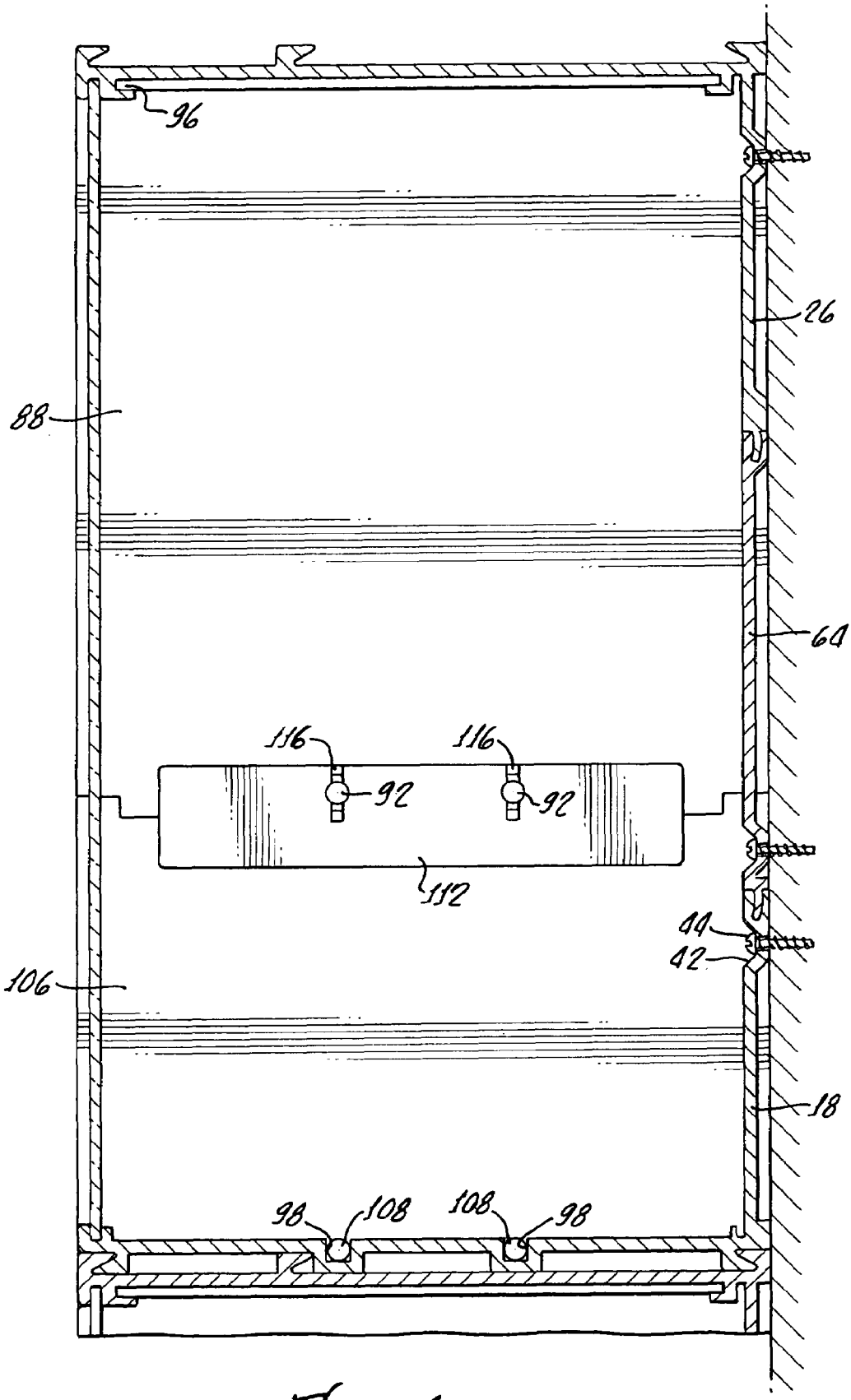
FIG. 4 is a cross sectional view taken along the line of 4-4 of FIG. 1.

To accommodate for an extended height D, end cap extensions 106 are provided, see FIGS. 2 and 4. The end cap extensions 106 include rods 108 sized for fitting the grooves 98 and a support member 112 including grooves 116 for receiving the rods 92 of the end caps 88.

It should also be appreciated that multiple back extensions 64 may be coupled to one another along with end cap extensions 106 in order to adjust the distance D to any desired sized in accordance with the present invention.

Although there has been hereinabove described a specific modular expandable display case in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A display case comprising:

at least one L shaped bottom member having a bottom and an upstanding back;

at least one L shaped top member having a top and a depending back;

a tongue disposed on an edge of one of the backs and a groove disposed on an edge of another of the backs for coupling the backs to one another;

a longitudinal recess formed into each of the backs for enabling wall mounting screw heads to be countersunk in the backs;

end caps configured for engaging the bottom and top for closing ends of the bottom member and top member;

a back extension having an extension tongue disposed on one end thereof for engaging the back tongue and an extension groove on another and thereof for engaging the back groove in order to extend a distance between the top and bottom upon assembly of the bottom member, top member and back extension;

a longitudinal recess formed into said back extension for enabling wall mounting screw head to be countersunk in said back extension;

end cap extensions, each having a length equal to said back extension and each configured for engaging a respective end cap, back, top and back extension for closing ends of the bottom and top members; and flanges formed in one of the top and bottom and slots formed in another of the top and bottom for enabling stacked coupling of a plurality of display cases.

2. The display case according to claim 1 further comprising channels disposed in the top and bottom and rods for enabling side by side coupling of display cases.

3. A display case comprising:

a plurality of L shaped bottom members each having a bottom and an upstanding back;

a plurality of L shaped top members each having a top and a depending back;

pairs of bottom and top members each having a tongue disposed on an edge of one of the backs and a groove disposed on another of the backs for coupling the pair together;

channels disposed in the top and bottom and rods for enabling side by side coupling of the pairs; and end caps configured for engaging each pair for closing ends of each bottom member and top member.

4. The display case according to claim 3 comprising flanges formed in one of the top and bottom of each pair and slots formed in another of the top and bottom of each pair for enabling stacked coupling of the pairs.

5. The display case according to claim 4 further comprising at least one back extension having an extension tongue disposed on one end thereof for engaging the back tongue and a groove on another end thereof for engaging the back groove of a selected pair in order to extend a distance between the top and bottom upon assembly of the selected pair with the back extension.

6. The display case according to claim 5 further comprising an end cap extension having a length equal to said back extension and configured for engaging a respective end of the selected pair and back extension for closing ends of the selected pair.

7. The display case according to claim 6 further comprising longitudinal recesses formed in the backs and back extension for enabling wall mounting screw heads to be countersunk in the backs and back extension.

* * * * *